US005863129A

United States Patent [19]

Smith

[11] Patent Number: 5,863,129

[45] Date of Patent: Jan. 26, 1999

[54] SERIAL RESIN MIXING DEVICES

[75] Inventor: Gary L. Smith, Costa Mesa, Calif.

[73] Assignee: Gary A. Smith, Costa Mesa, Calif.; a part interest

[21] Appl. No.: 2,813

[22] Filed: Jan. 5, 1998

[51] Int. Cl.[6] ..... B01F 5/06

[52] U.S. Cl. ..... 366/340; 138/42

[58] Field of Search ..... 366/181.5, 336–340; 48/189.4; 138/37, 39, 40, 42, 44

[56] References Cited

U.S. PATENT DOCUMENTS

| | | | |
|---|---|---|---|
| 3,089,683 | 5/1963 | Thomas et al. | 366/340 |
| 3,526,391 | 9/1970 | Church, Jr. | 366/340 |
| 3,855,368 | 12/1974 | Prochazka et al. . | |
| 3,856,270 | 12/1974 | Hemker et al. | 366/340 |
| 3,941,355 | 3/1976 | Simpson . | |
| 4,027,857 | 6/1977 | Cunningham . | |
| 4,109,363 | 8/1978 | Velarde . | |
| 4,124,309 | 11/1978 | Yao . | |
| 4,135,180 | 1/1979 | White . | |
| 4,222,671 | 9/1980 | Gilmore . | |
| 4,305,672 | 12/1981 | Adams . | |
| 4,361,407 | 11/1982 | Pellegrini . | |
| 4,441,823 | 4/1984 | Power . | |
| 4,514,095 | 4/1985 | Ehrfeld et al. . | |
| 4,591,274 | 5/1986 | Sulin . | |
| 4,679,628 | 7/1987 | Luetzelschwab . | |
| 4,869,849 | 9/1989 | Hirose et al. | 366/340 |
| 5,137,369 | 8/1992 | Hodan . | |
| 5,397,179 | 3/1995 | Berlin et al. . | |
| 5,516,209 | 5/1996 | Flint et al. . | |
| 5,547,281 | 8/1996 | Brooks . | |

FOREIGN PATENT DOCUMENTS

| | | | |
|---|---|---|---|
| 58-150421 | 9/1983 | Japan | 366/336 |

*Primary Examiner*—Charles E. Cooley
*Attorney, Agent, or Firm*—James G. O'Neill

[57] ABSTRACT

A series of flow control mixing devices used in a mixing chamber in a spray gun, or the like, to more thoroughly mix multi-components in a mixing chamber, consists of three different types of cylindrical mixing elements sealingly held in the chamber. Each of the mixing elements contains a pair of inlets, a central chamber and an outlet, connected together so as to mix entering components therein, and passing these mixed components to the outlet. Two of the types of mixing elements include a mixing reservoir or chamber formed on a top surface thereof. A plurality of second mixing elements are secured over a first or downstream mixing element, and a final or third mixing element is provided upstream of the other elements. The first element includes a spacing member on the lower surface, and all the mixing elements include O-ring seals held in grooves formed on the outer periphery thereof. The O-ring seals also act to both seal the mixing elements in the mixing chamber and the opposed ends of through passages formed within each of the mixing elements.

16 Claims, 2 Drawing Sheets

SERIAL RESIN MIXING DEVICES

BACKGROUND OF THE INVENTION

1. Field of the Invention

This invention relates generally to mixing devices and, more particularly, to a series of mixing devices for use in mixing several components within a mixing chamber.

2. Description of Related Art

Many types of static mixing devices are known, and have been used in the past for mixing an epoxy resin with a catalyst or promoter for delivering to a spraying apparatus, for spraying through a nozzle. In particular, in one of the most useful plural component systems, such as a fiberglass system, after the components are mixed, they are sprayed through a nozzle and atomized into a fine spray pattern. To reduce the styrene emissions from such fine spray, the fiberglass spray guns are augmented with a chopper assembly, which chops up a fiberglass roving, and concurrently sprays short segments of fiberglass into the spray pattern of the mixed resin and catalyst ejected from the nozzle.

It is important that the plural components, such as a resin and a catalyst, be thoroughly mixed before they are sprayed from a spray gun to ensure a proper reaction to polymerize the resin into a solid, coherent mass after it is applied to an exterior surface. Known static mixing devices include various combinations of single elements or a series of elements having various openings and passages therethrough. These elements are held in a mixing chamber within a body, such as a spray gun, or other device.

Although the known mixers work well for their intended purposes and effectively mix some viscous liquids, problems have been encountered when the mixing devices are allowed to sit for awhile before they are cleaned or back up may occur, depending on the size of the inlet, mixing and outlet chambers connected to the devices.

Furthermore, the known mixing devices are expensive and time consuming to manufacture, and are hard to properly seat and seal in position, thereby causing inconsistent mixing of the resin and the catalyst, or other liquids.

Thus, there is a need in the art for an inexpensive, easy-to-manufacture, assemble and disassemble series of mixing devices for use in a plural component system, and which series of mixing devices are provided with sealing means to ensure proper seating and a consistent mixing of components traveling therethrough, in an improved and unique manner.

SUMMARY OF THE INVENTION

Accordingly, it is a general object of the present invention to provide an improved serial mixing device. It is a particular object of the present invention to provide an improved series of mixing devices which are easy and simple to manufacture. It is a still more particular object of the present invention to provide an improved series of mixing devices for a multi-component spray gun which thoroughly and consistently mix the components traveling therethrough. It is yet another more particular object of the present invention to provide an improved series of mixing devices having O-ring seals held therein. It is a further particular object of the present invention to provide a series of mixing devices having at least three different types of elements having two inlets and a single outlet opening, with a central mixing chamber therein. And, it is yet a still further particular object of the present invention to provide a series of different mixing devices held together in a mixing chamber which are easy and inexpensive to make, and which contain grooves for holding O-ring seals to both seal each mixing element in place and block opposite end openings of a through passage formed therein.

In accordance with one aspect of the present invention there is provided a series of different mixing devices consisting of a first or downstream device having a foot or spacer which is held against a bottom surface of a mixing chamber, at least one second mixing device having substantially the same structure as the first device, except for the foot, and a third mixing element, similar to the second device, but having an outer lip thereon.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in conjunction with the accompanying drawings, in which:

DESCRIPTION OF THE PREFERRED EMBODIMENTS

The following description is provided to enable any person skilled in the art to be able to use the invention and sets forth the best modes contemplated by the inventor for carry out his invention. Various modifications, however, will remain readily apparent to those skilled in the art, since the generic principals of the present invention have been defined herein, specifically to provide for a series of novel and improved mixing means, devices or elements, indicated generally at 10.

Figure 1:
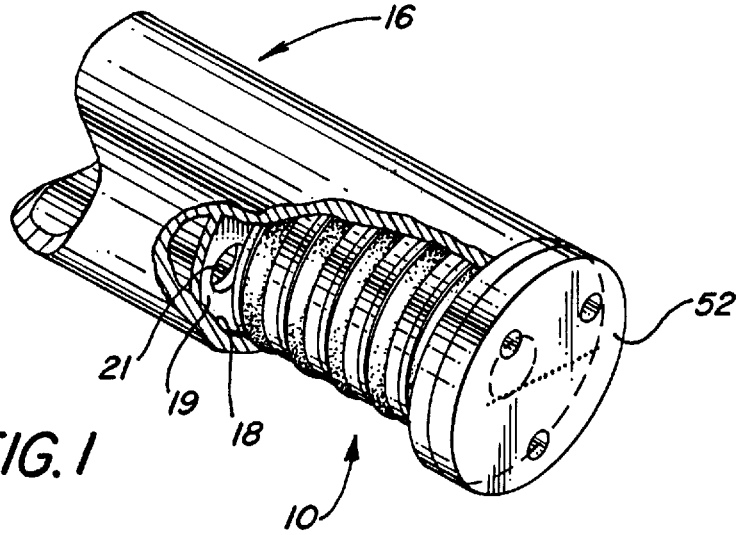
FIG. 1 is a perspective view, partly in cross-section, showing a series of the novel mixing elements of the present invention held within a mixing chamber of a device, such as a spray gun.

Turning now to the drawings, there shown in FIG. 1 is an elongated mixing chamber 16, having a series of improved mixing elements of the present invention to form the mixer 10, sealingly held in an inner chamber 18. The inner chamber 18 may be in a spray gun, or the like, and be of any desired size, as long as each of the serial mixing devices which form the mixer 10 are sealingly held therein by means of O-rings seals 20. The O-rings 20 are held within grooves in each separate mixing device 11, 12, 14, making up the mixer 10, as explained more fully below. The length and diameter of the internal mixing chamber 18, as well as the exterior diameter of each separate mixing element 11, 12 and 14, together with the O-rings 20 held therein will be so selected that they will be sized and dimensioned to enable each of the separate mixing elements to be slid into the internal chamber 18 and sealingly held against each other and in the inner chamber 18. The overall length of the inner chamber 18 will depend on the device in which it is contained, and is selected so that a predetermined number of separate mixing devices 11, 12 and 14, such as the five shown in FIGS. 1 and 2, will then be held therein in an operative relationship.

The serial mixing devices or elements of mixer 10 of the present invention are preferably formed as cylindrical bodies, mounted before or behind a nozzle or an emissions reducing flow control plate 52, such as disclosed in Applicant's co-pending application Ser. No. 09/000,855 filed on Dec. 30, 1997, to more thoroughly mix flowable components, such as resin and catalyst components entering the mixing chamber and exiting through a final outlet of the mixer 10.

Figure 3:
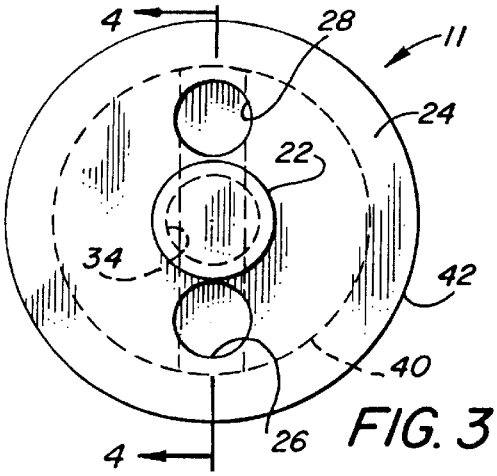
FIG. 3 is a bottom plan view of a first embodiment of a mixing element which may be used as a first or downstream element in a mixing chamber.
Figure 4:
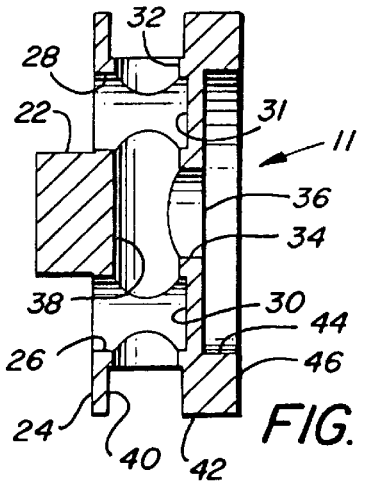
FIG. 4 is a cross-sectional view of the mixing element of FIG. 3, taken along line 4—4.

The present invention preferably utilizes three different types of mixing devices 11, 12 and 14, each of which has two inlet openings, a single outlet opening and a central mixing chamber formed by four passageways, drilled, or otherwise provided therein. The three different types of mixing elements are preferably cylindrical and more clearly shown in FIGS. 3–8. The first or downstream mixing element 11 includes a foot or spacer 22 formed on or extending from a flat bottom surface 24 thereof. It is to be understood that this first mixing element 11 is placed in the downstream end of the inner chamber 18, with the foot or spacing element 22 facing toward the downstream end of the inner chamber, and inserted until the foot bottoms out or contacts an end wall 19. The inner chamber 18 includes at least two inlet openings 21 in the end wall 19, only one of which is shown, to allow multiple flowable components, such as a resin and a catalyst to enter the inner chamber, under pressure. With the spacer or foot 22 resting against the end wall 19 of the inner chamber 18, the components entering into the inner chamber via openings 21 will impinge upon flat bottom surface 24 and move around foot 22 until they enter the two inlet passageways 26, 28 of the first mixing element 11, as shown in FIGS. 3 and 4. These passageways 26, 28 are preferably circular and formed by drilling a pair of identical sized holes through the bottom face 24 until each passageway ends or bottoms out at or against an inner wall 30, 31. Additional circular passageways 32, 34 are also formed in the first element 11, as by drilling holes, a first of which, 32 is perpendicular to the inlet passageways, and the other of which, 34 is parallel thereto. These passageways 32, 34 are connected to or form an internal mixing chamber 38 and an outlet opening 36. Also, a groove 40 is formed around the outer periphery 42 of the cylindrical mixing element 11.

Figure 2:
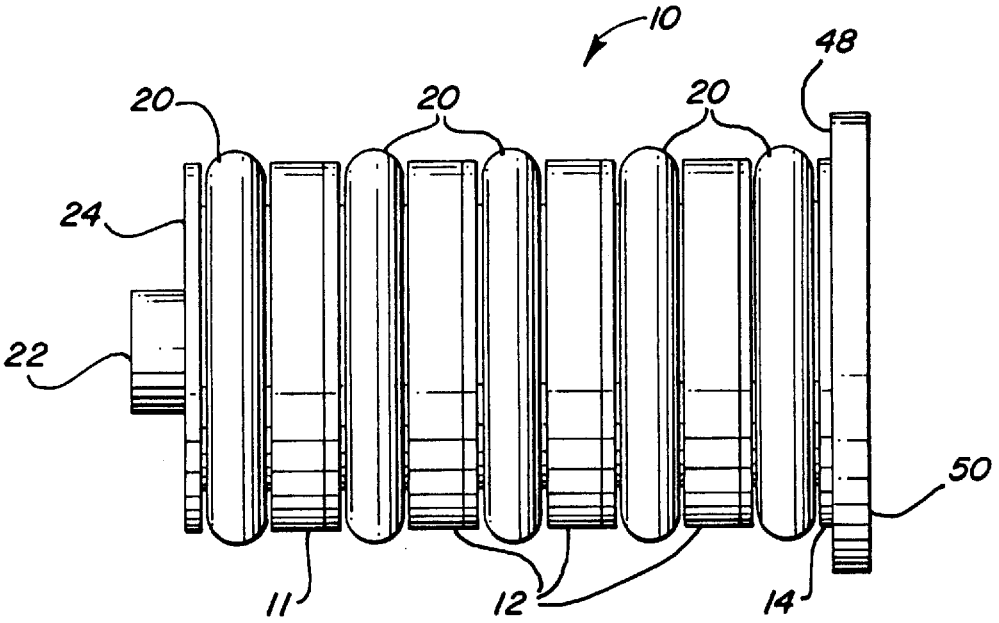
FIG. 2 is a side elevational view of a series of five mixing elements of the present invention as shown in FIG. 1.

As shown most clearly in FIG. 4, the passageway 32, perpendicular to the inlet passageways 26, 28 and outlet passageway 34, is formed along a diameter of and passes entirely through a central portion of the cylindrical body of element 11, and includes diametrically opposite open ends in the groove 40. The outlet passageway 34 is connected to the inner chamber 38. Although not shown in FIG. 4, an O-ring seal 20 is placed in the groove 40, and is sized and dimensioned so that it extends outwardly from the groove, as shown in FIGS. 1 and 2. This O-ring 20 acts to both seal the first element 11 within the internal chamber 18, and block or close the opposite open ends of the passageway 32 in groove 40.

Mixed components, after passing through inner chamber 38, outlet passageways 34, and exiting through the outlet 36 of mixer 11, enter a cylindrical opening or reservoir 44 formed in a flat top surface 46 of mixing element 11.

Figure 5:
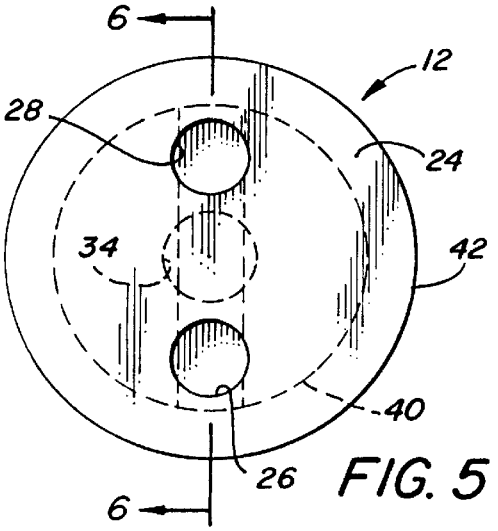
FIG. 5 is a bottom plan view of a second embodiment of a mixing element, which may be used between upstream and downstream mixing elements.
Figure 6:
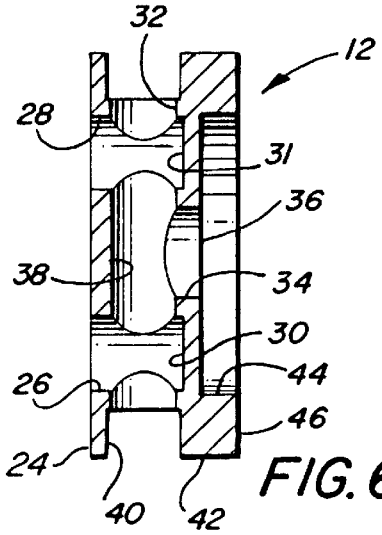
FIG. 6 is a cross-sectional view of the mixing element of FIG. 5, taken along line 6—6.

As shown in FIGS. 1 and 2, a plurality of the second type of mixing elements 12 are held in the inner chamber 18. Each of these elements 12 is identical, and constructed as shown in FIGS. 5 and 6. In the embodiment of the invention described herein, three mixing elements 12 are held between the first element 11 and the third element 14, although fewer or more second mixing elements 12 may be used. The second mixing elements 12 are substantially identical to the first mixing element 11, except that they do not have a foot or spacing element 22 formed on or extending from the flat bottom face 24. That is, each element 12 includes a flat bottom face 24, inlet passageways 26, 28, and the remaining passageways, etc. 32–46, as shown in FIGS. 4 and 6.

Figure 7:
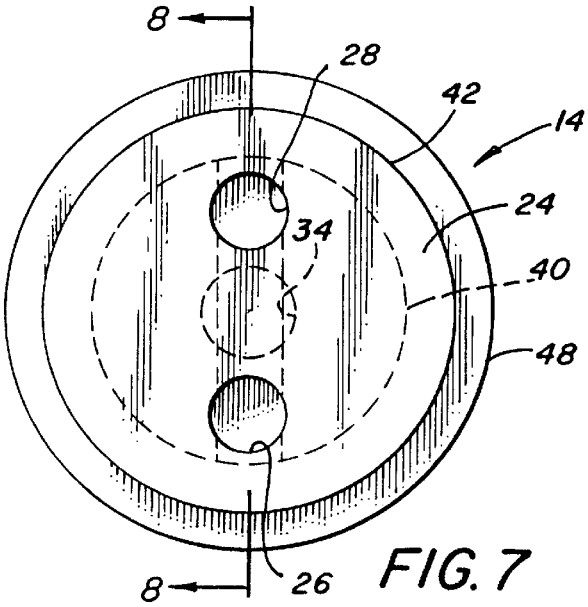
FIG. 7 is a bottom plan view of a third or upstream mixing element of the present invention.
Figure 8:
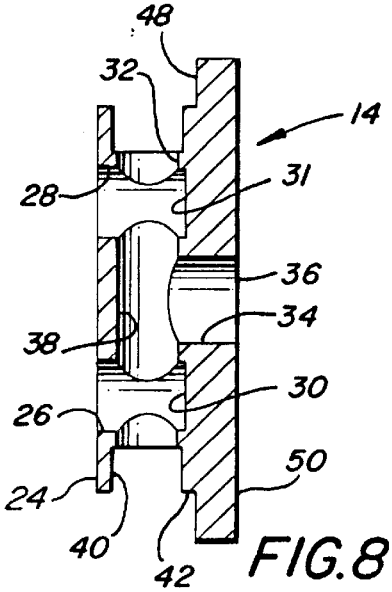
FIG. 8 is a cross-sectional view of the mixing element of FIG. 7, taken along line 8—8.

Finally, an outer, third or upstream mixing element 14 is inserted into the mixing chamber 18 on top of the second mixers 12, as shown in FIGS. 1 and 2. As best shown in FIGS. 7 and 8, this third mixing element contains a flat bottom surface 24, inlet passageways 26, 28, a perpendicular passageway 32, an outlet passageway 34, an outlet 36, an interior cylindrical chamber 38, a groove 40, and a portion of an outer periphery 42, which are identical to those of the second mixing elements. The third mixing element 14, however, also includes an extending, annular lip 48 and a flat upper surface 50, and does not include a reservoir 44. The annular lip 48 may be used to secure the assembled mixer 10 in the chamber 18, as by being held in a recessed opening, or held against the outer end of the mixing chamber 16. The annular lip and flat upper surface 50 may be held in place by any desired flow control or holding means 52, which may take the form of an emissions reducing flow control plate, such as shown in FIG. 1, or a nozzle.

As shown most clearly in FIGS. 1 and 2, the series of first, second and third mixing elements 11, 12 and 14 of the present invention are used by first have O-rings 20 placed in grooves 40. Each element is then inserted in a mixing chamber, such as 16, before or behind a flat control plate, or nozzle 52, in a device, such as a spray gun, or the like. Each mixing element 11, 12, 14 with an O-rings 20 held in its respective groove 40 is pushed into inner chamber 18, so as to be in contact with adjacent mixing elements and to be sealingly held in the inner chamber. In this position, the O-ring seals both cooperate with the inner surface of the inner chamber to seal the mixing element in place and to close or seal off the opposite open ends of the perpendicular passageways 32 in each mixing element. At least three elements 11, 12, and 14 should be utilized, to thoroughly mix components. However, depending on the length of the inner mixing chamber 18, a plurality of central or second elements 12, such as the three shown in FIGS. 1 and 2, are used to provide the requisite length and to more thoroughly mix components passing therethrough.

Referring now to FIGS. 4, 6, and 8, the flow of mixed components through each of the elements 11, 12, and 14 is as follows: the components enter the inlet passageways 26, 28 of the first element 11 and flow through the inlet passageways until they impinge upon the inner ends 30, 31, where they will then be turned at right angles into the central, cylindrical mixing chamber 38, where the entering components will be more thoroughly mixed. The mixed components will then flow at a further right angle through the outlet passageway 34 and out the outlet 36. After exiting from the outlet 36, the mixed components will impinge on the bottom wall 24 of a contacting second mixing element 12, and/or flow into the reservoir 44. From the reservoir 44, the mixed components then enter into the inlet passageways 26, 28 of one or more second elements 12. Flow through all of the second elements 12 will be identical to that through the first element 11, as described above. After passing through all of the second elements 12 and entering reservoir 44 of the last of the second elements, the mixed components will enter the inlet passageways 26, 28 in the third or upstream element 14, and travel therethrough in the same manner described above, until the mixed components exit through the outlet 36 of element 14. Upon exiting outlet 36 of element 14, the mixed components may be directed into a flow control plate or nozzle 52, for controlled spraying thereof.

Therefore, it can be seen that components passing through the mixer 10 of the present invention will be thoroughly mixed in the three types of mixing elements serially held therein. Each of the mixing elements may be cheaply and easily made in simple machining processes, as, for example, taking blank cylindrical elements and forming a groove 40 and reservoir 44, then drilling passageway 32, and passageways 26, 28 and 36.

It, thus, can be seen that the serial mixing elements of the present invention provide an improved, easy-to-use and manufacture system for accurately and more thoroughly mixing plural components in a sealed fashion in a mixing chamber of a spray gun, or the like.

Those skilled in the art will appreciate that various adaptations and modifications of the just-described, preferred embodiments can be configured without departing from the scope and spirit of the invention. Therefore, it is to be understood that, within the scope of the appended claims, the invention may be practiced other than as specifically described herein.

What is claimed is:

1. A mixer for mixing at least two flowable components, comprising:

a mixing chamber having an elongated, hollow, inner chamber with a first or downstream end, having at least two openings therein to receive pressurized, flowable components;

a plurality of separate mixing elements sealingly held in the elongated, hollow, inner chamber between the first downstream end and a second upstream end of the elongated, hollow, inner chamber;

the plurality of separate mixing elements including three different types of mixing elements consisting of a first downstream element, at least one second element and a third upstream element; and each of the plurality of separate mixing elements including a through passageway ending in a groove on an outer edge of the mixing element, a sealing member held in the groove and sealing opposed ends of the through passageway, the sealing member cooperating with an interior wall of the elongated, hollow, inner chamber.

2. The mixer of claim 1 wherein each of the plurality of mixing elements includes a pair of inlet passageways and an outlet passageway connected to the through passageway.

3. The mixer of claim 2 wherein each of the pair of inlet passageways and the outlet passageway are formed perpendicularly to the through passageway.

4. The mixer of claim 3, further including an exit reservoir connected to the outlet passageway in some of the plurality of mixing elements.

5. The mixer of claim 4, further including a foot member formed on the first downstream element; the foot member being adapted to cooperate with the first end of the elongated, hollow, inner chamber.

6. The mixer of claim 5, further including an annular lip formed on the third upstream element; the annular lip being adapted to cooperate with the second upstream end of the elongated, hollow, inner chamber.

7. The mixer of claim 6 wherein only the first downstream element and the at least one second element include the exit reservoir formed therein.

8. The mixer of claim 1 wherein each of the plurality of mixing elements includes a pair of inlet passageways and an outlet passageway connected to the through passageway forming a mixing chamber.

9. The mixer of claim 8, further including an exit reservoir connected to the outlet passageway in the first downstream element and the at least one second element.

10. The mixer of claim 9 wherein the sealing member is an O-ring.

11. The mixer of claim 10 wherein each of the pair of inlet passageways and the outlet passageway are formed perpendicularly to the through passageway.

12. The mixer of claim 11, further including a foot member formed on the first downstream element; the foot member being adapted to cooperate with the first end of the elongated, hollow, inner chamber.

13. The mixer of claim 12, further including an annular lip formed on the third upstream element; the annular lip being adapted to cooperate with the second upstream end of the elongated, hollow, inner chamber.

14. A mixer for mixing at least two flowable components, comprising:

a mixing chamber having an elongated, hollow, inner chamber with a first downstream end, having at least two openings therein to receive pressurized, flowable components, and a second upstream end;

a plurality of separate mixing elements sealingly held in the elongated, hollow, inner chamber between the first downstream end and the second upstream end of the elongated, hollow, inner chamber;

the plurality of separate mixing elements including three different types of mixing elements consisting of a first downstream element, at least one second element and a third upstream element;

each of the plurality of separate mixing elements including an O-ring sealing member held in a groove formed therein and cooperating with an interior wall of the elongated, hollow, inner chamber; and the O-ring also sealing opposed ends of a through passageway ending in the groove of each of the plurality of mixing elements.

15. The mixer of claim 14 wherein each of the plurality of mixing elements includes a pair of inlet passageways and an outlet passageway formed perpendicularly to and fluidly connected to the through passageway; the first downstream element includes a foot member for cooperating with the first end of the elongated, hollow, inner chamber; the third upstream element includes an annular lip member; and only the first downstream element and the at least one second element include exit reservoirs formed therein adjacent their respective outlets.

16. A mixer for mixing at least two flowable components, comprising:

a mixing chamber having an elongated, hollow, inner chamber with a first downstream end, having at least two openings therein to receive pressurized, flowable components, and a second, open, upstream end;

a plurality of separate mixing elements sealingly held in the elongated, hollow, inner chamber between the first downstream end and the second, open, upstream end;

the plurality of separate mixing elements including three different types of mixing elements consisting of a first downstream element, a plurality of second elements and a third upstream element;

each of the plurality of separate mixing elements including an O-ring sealing member held in a groove formed therein and cooperating with an interior wall of the elongated, hollow, inner chamber and with opposite openings of a through passageway extending through each of the separate mixing elements;

a foot member formed on the first downstream element; the foot member cooperating with the first upstream end of the elongated, hollow, inner chamber;

an annular lip formed on the third upstream element; the annular lip cooperating with the second, open, upstream end of the elongated, hollow, inner chamber;

each of the plurality of mixing elements including a pair of inlet passageways and an outlet passageway connected to the through passageway; and an exit reservoir connected to the outlet passageway in the first downstream element and the plurality of second elements.

* * * * *